US005354184A

United States Patent [19]

Forni

[11] Patent Number: 5,354,184

[45] Date of Patent: Oct. 11, 1994

[54] WINDAGE LOSS REDUCTION ARRANGEMENT FOR SCROLL FLUID DEVICE

[75] Inventor: Ronald J. Forni, Lexington, Mass.

[73] Assignee: Arthur D. Little, Inc., Cambridge, Mass.

[21] Appl. No.: 837,964

[22] Filed: Feb. 20, 1992

[51] Int. Cl.[5] ..... F01C 1/04; F01C 21/00; F04B 35/04

[52] U.S. Cl. ..... 417/410.5; 418/55.1; 418/188

[58] Field of Search ..... 418/47, 55.1, 55.4, 418/188; 417/410 D

[56] References Cited

U.S. PATENT DOCUMENTS 4,514,150 4/1985 Hiraga et al. ..... 418/55.1
4,815,951 3/1989 Kakuda et al. ..... 418/55.1
4,927,339 5/1990 Riffe et al. ..... 418/188
4,936,756 6/1990 Shimizu et al. ..... 418/188

FOREIGN PATENT DOCUMENTS 62-126284 6/1987 Japan ..... 418/55.1
3-96678 4/1991 Japan ..... 418/55.1

*Primary Examiner*—John J. Vrablik
*Attorney, Agent, or Firm*—Bacon & Thomas

[57] ABSTRACT

A windage loss reduction system for a co-rotating scroll fluid device includes clearance reducing or optimizing elements mounted between rotating and fixed members of the scroll fluid device and which may be used individually or collectively to reduce centrifugal and axial fluid flow of ambient gases caused the rotating elements to improve the efficiency of the scroll fluid device. The windage loss reducing elements are located between fixed housing elements and the rotor, drive shaft, and scroll elements of the device.

8 Claims, 4 Drawing Sheets

WINDAGE LOSS REDUCTION ARRANGEMENT FOR SCROLL FLUID DEVICE

BACKGROUND OF THE INVENTION

1. Field of the Invention

The present invention pertains to a windage loss reduction arrangement for use in a scroll fluid device. The windage loss arrangement includes various elements mounted between rotating and fixed members of a scroll fluid device and which may be used individually or collectively in order to reduce axial fluid flow resulting from radial centrifugal flow of ambient fluid induced by the rotating elements to increase efficiency of the scroll system by reducing driving energy consumption.

2. Related Background Technology and Art

Any mechanical device rotating at high speed generates a centrifugal flow of ambient fluid radially outwardly due to the friction between the ambient fluid and the rotating mechanism, such flow conventionally referred to as "windage." If the rotating mechanism is contained within a larger housing, the flow of fluid is directed radially outwardly and flows axially relative to the rotating mechanism. Normally, such circulatory flow is harmless and does not enter into considerations of efficiency with respect to the energy required to generate the flow of circulating fluid within the housing. However, under some circumstances it may be highly desirable to curtail the radial centrifugal flow of ambient fluid surrounding a spinning element to minimize the energy loss associated with the generation of such windage.

In co-rotating scroll fluid devices using opposed, meshed, axially extending, co-rotating involute wraps that orbit relative to each other without rotating relative to each other, the centrifugal flow of ambient fluid or the energy loss due to such "windage", is normally insufficient to merit detailed consideration from an efficiency standpoint. However, as scroll fluid devices are operated at increasingly higher speeds and efficiency becomes a paramount consideration, a detailed review of all energy losses associated with the operation of the scroll fluid device must be made, including windage effects.

It has become apparent that it is highly desirable in a spinning scroll fluid device operating at high speed and at maximum efficiency to reduce losses due to windage effects between spinning components of the scroll device and adjacent fixed components.

SUMMARY OF THE INVENTION

The present invention provides a windage loss reduction arrangement for a scroll fluid device which optimizes the clearances between fixed and rotating members of the device in order to reduce centrifugal fluid flow resulting from windage. The windage loss reduction arrangement of the present invention is particularly adapted for use in a scroll fluid device having driving and driven co-rotating scroll members located in a fixed housing but also could have application in a non-co-rotating, orbiting scroll system.

In the preferred embodiment, the windage loss reduction arrangement is used in a scroll fluid device having various rotating members including a drive shaft, a rotor of an electric motor which drives the drive shaft, a drive plate rotating with the drive shaft, a drive scroll which is mounted and fixedly secured to the drive plate and a driven scroll which is adapted to co-rotate with the drive scroll. The windage loss reduction arrangement includes various elements which are located between the housing or fixed structure, on the one hand, and the rotor, the drive shaft, the drive plate and the scrolls, on the other hand. As disclosed herein, these elements include upper and lower annular rings which control the clearances between the housing and the drive shaft and/or rotor; an annular disc which is located between and controls the clearance between the housing and the annular drive plate; and a screen member which is located in a fluid path between the fixed housing and the rotating scroll elements for controlling the clearance between the housing and rotating scroll elements.

DETAILED DESCRIPTION OF A PREFERRED EMBODIMENT

Although the present invention may be applied to various types of scroll fluid devices, it is depicted and described for exemplary purposes embodied in a hermetically sealed scroll refrigerant compressor which is adapted to be used in a closed-loop expanded-condenser refrigeration system.

Figure 1:
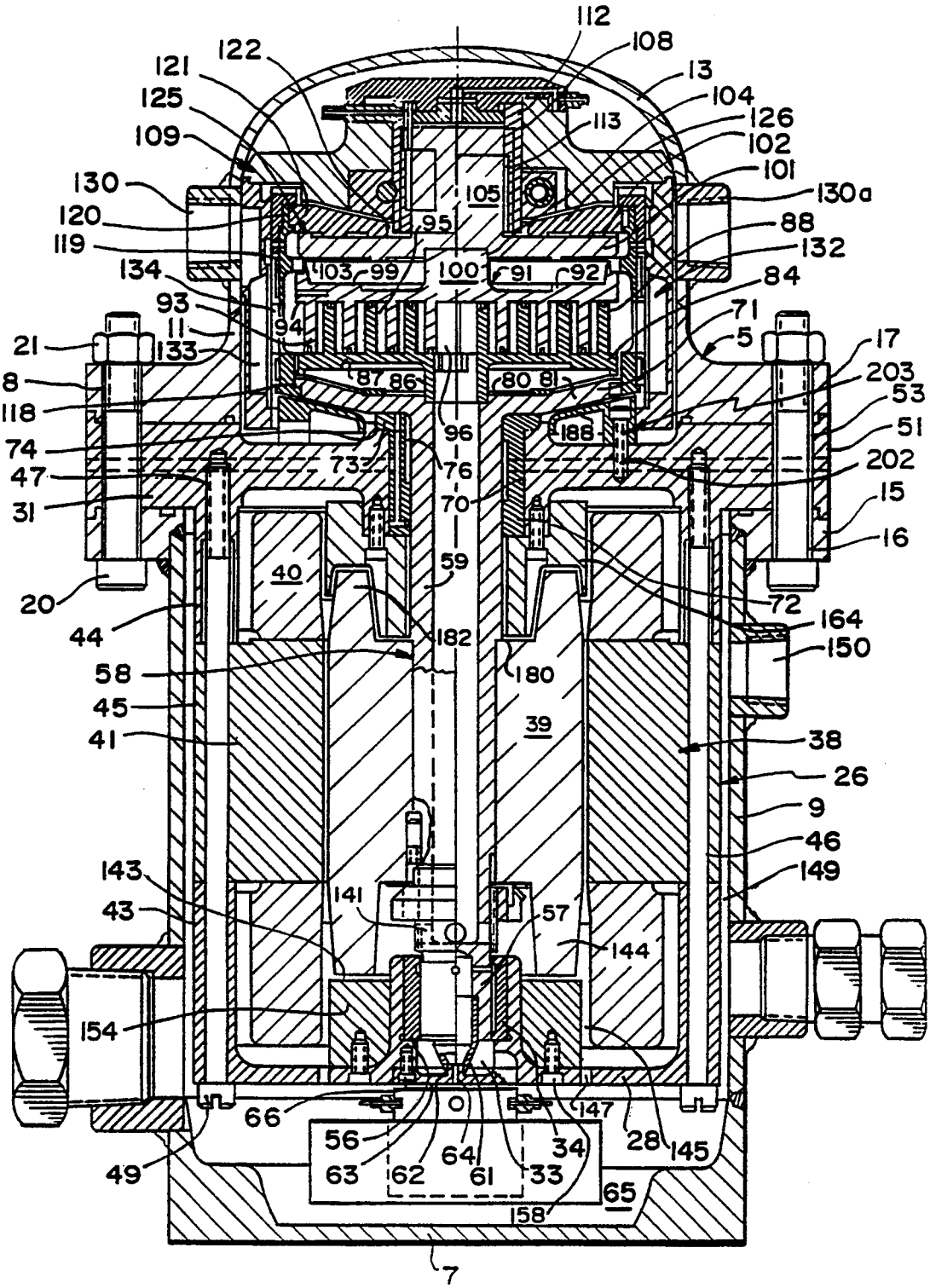
FIG. 1 is a cross-sectional elevational view of a scroll-type compressor incorporating the windage loss reduction arrangement of the present invention.
Figure 2:
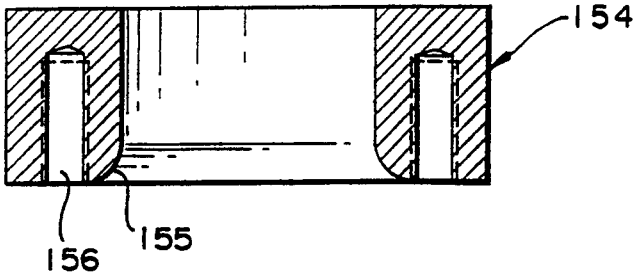
FIG. 2 is an expanded view of a first element of the windage loss reduction arrangement of the present invention.

With initial reference to FIG. 1, a compressor is shown comprising a housing assembly 5 including a base plate 7, a lower housing section 9, an upper housing section 11 and a cover member 13. The upper end of lower housing section 9 includes a radially transversely extending annular flange 15 that is either integrally formed therewith or fixedly secured thereto by any means known in the art, such as by welding. Annular flange 15 has various circumferentially spaced apertures 16 extending substantially longitudinally therethrough. The lower end of upper housing section 11 also includes an annular flange 17 including various apertures 18 which are longitudinally aligned with apertures 16 for receiving fasteners such as bolts 20 and nuts 21 for fixedly securing upper housing section 11 to lower housing section 9 as will be more fully described herein.

Located within lower housing section 9 is a motor assembly 26. Motor assembly 26 includes a bottom plate 28 and an upper crosspiece 31. Located in bottom plate 28 is a lower central aperture 33 defined by an upstanding annular bearing flange 34. Mounted within motor assembly 26 is an electric motor 38 including a rotor 39 rotatable about a longitudinal central axis, windings 40 and a lamination section 41. The exact mounting of motor 38 will be more fully discussed hereinafter.

As depicted, motor assembly 26 includes a lower skirt section 43 integrally formed with bottom plate 28, an upper skirt section 44 formed integral with crosspiece 31 and a central skirt section 45 which is part of lamination section 4.1. Lower, upper and central skirt sections 43, 44, 45 include an aligned, elongated vertical aperture extending therethrough at circumferentially spaced locations. Aligned with apertures ,$6, in upper crosspiece 31, is an internally threaded bore 47. Motor assembly 26 is secured together by various bolts 49 which extend through apertures 46 and are internally threaded into bore 47 of upper crosspiece 31.

Upper crosspiece 31 includes an annular flange 51 which mates with annular flange 15 of lower housing section 9 and annular flange 17 of upper housing section 11. Annular flange 51 further includes a plurality of circumferentially spaced apertures 53 which can be aligned with apertures 16 and 18 formed in lower housing section 9 and upper housing section 11 respectively. Bolts 20 are then adapted to extend through aligned apertures 16, 53 and 18 and nuts 21 are secured to the bolts 20 in order to fixedly secure upper housing section 11 to lower housing section 9 with upper crosspiece 31 of motor assembly 26 therebetween. By this construction, motor assembly 26 is thereby secured within lower housing section 9.

Press-fit or otherwise secured within upstanding annular bearing flange 34 of bottom plate 28 is a lower bearing sleeve 56. Rotatably mounted within lower bearing sleeve 56 is a lower end 57 of a longitudinal extending hollow drive shaft 58. Drive shaft 58 includes an upper hollow section 59 separated by a partition from the lower end 57. Located within lower hollow end 57 is an oil cup 61 which tapers inwardly in a downward direction. Oil cup 61 is secured to drive shaft 58 and rotates freely about central knob 62 formed in an attachment plate 63. Knob 62 includes a centrally located through-hole 64 communicating between the interior of oil cup 61 and a lower sump 65 in order to permit lubricating fluid to flow into and out of oil cup 61. Attachment plate 63 is secured to bottom plate 28 by means of various bolts 66.

Upper section 59 of drive shaft 58 extends through a central opening 70 in crosspiece 31 and terminates in an integrally formed drive plate 71. Central opening 70 houses an upper bearing sleeve 72 which includes an upper transverse flange 73 embedded in a recess 74 formed in an upper surface of crosspiece 31. Upper bearing sleeve 72 includes a clearance passage 76 for the draining of lubricating fluid bearing medium. Drive plate 71 is dish-shaped and includes a substantially horizontal, central portion 80 and an upwardly sloping outer portion 81.

Located above dish-shaped drive plate 71 is a drive scroll 84 that includes a central, hollow sleeve portion 86, a wrap support plate 87 and an involute spiral wrap 88. Central, hollow sleeve portion 86 is fixedly secure to drive shaft 58 through drive plate 71. Intermeshingly engaged with drive scroll 84 is a driven scroll 91 having a wrap support plate 92 with an involute spiral wrap 93 extending downwardly from a lower first side 94. As is known in the art, defined between involute spiral wrap 88 and involute spiral wrap 93 are fluid chambers 95 that, in this example, transport and compress gaseous refrigerant radially inwardly between the scroll flanks. Typically, the scroll fluid device would operate at a high speed within a gaseous fluid medium surrounding the rotating scroll wraps so that, when the device is operated as a compressor, fluid intake occurs at the outer end of each scroll wrap and output flow through the device occurs at central output port 96. Of course, it should be understood that such scroll fluid devices can be operated as an expander by admitting pressurized fluid at port 96 and causing it to expand within the radially outwardly moving fluid chambers 95, to be discharged at the outer ends of the scroll wraps. However, for the purposes of the remainder of this description, it will be assumed that the scroll fluid device illustrated is arranged to function as a compressor.

The upper, second side 99 of wrap support plate 92 is formed with an integral central projection 100. Disposed vertically above driven scroll 91 is a pressure plate 101 having an upper side surface 102 and a lower side surface 103. Formed in lower side surface 103 is a central recess 104 into which central projection 100 of driven scroll 91 extends and is fixedly secured therein. On upper side surface 102, opposite recess 104, pressure plate 101 is formed with an axially projecting bearing support shaft 105. Bearing support shaft 105 extends into a central bore hole 108 formed in a fixed support plate 109 in upper housing section 11.

In this embodiment, drive scroll 84 and driven scroll 91 co-rotate and therefore a bearing sleeve 112 is mounted within bore 108 and extends about the periphery of bearing shaft 105. In addition, bearing sleeve 112 includes a clearance passage 113, analogous to clearance passage 76 previously discussed, for the draining of a lubricating fluid medium between bearing shaft 105 and bearing sleeve 112. It is possible, however, to fixedly secure driven scroll 91 and orbit drive scroll 84 about an orbit radius relative to scroll 91.

Extending upwardly from an outer perimeter 118 of drive plate 71 is an annular torque transmitting member 119. Secured to an upper, interior side wail 120 of torque transmitting member 119 is an annular bearing plate 121 having a central through-hole 122 therein through which bearing shaft 105 extends. An Oldham Coupling or synchronizer assembly, generally indicated at 125, is located between annular bearing plate 121 and upper side surface 102 of pressure plate 101 to maintain the drive and driven scrolls 84, 91 in fixed relationship in a rotational sense (i.e., so they cannot rotate relative to each other but maintain a fixed annular phase relationship relative to each other). Annular bearing plate 121 includes at least one clearance passage 126 for the introduction of high pressure oil to counteract the axial gas force developed and to lubricate the Oldham Coupling.

In order to drive the compressor, electric motor 38 operates in a conventional manner. Lamination section 41 is fixedly secured to upper and lower skirt sections 43,44 of housing assembly 5. Rotor 39, on the other hand, is secured to drive shaft 58 such that when motor 38 is activated, rotation of rotor 39 causes rotation of drive shaft 58, drive plate 71, drive scroll 84, annular torque transmitting member 119, annular bearing plate 121 and, in the preferred embodiment, driven scroll 91 through the Oldham synchronizer assembly 125 acting through pressure plate 101.

Formed as part of housing assembly 5, between upper housing section 11 and cover member 13, is a housing inlet port 130 which opens up into an inlet manifold 132. Inlet manifold 132 includes an inlet passage 133 leading to a scroll inlet port 134 formed in annular torque transmitting member 119, adjacent the involute spiral wraps 88 and 93. The scroll fluid intake zone is provided inside the torque transmitting member 119 around the periphery of the scrolls. Another port 130*a* may be provided optionally for instrumentation access.

When functioning as a compressor, gaseous refrigerant will enter the scroll fluid chambers 95 between spiral wraps 88, 93 through housing inlet port 130, inlet passage 133 and scroll inlet port 134. Upon activation of motor 38 and rotation of drive shaft 58, drive plate 71 and drive scroll 84, gaseous refrigerant will be pumped and compressed through the scroll device and will exit from scroll outlet port 96. Since scroll outlet port 96 opens into the hollow, upper section 59 of drive shaft 58, the compressed refrigerant will run downwardly through upper section 59. Just above lower end 57, drive shaft 58 includes a drive shaft outlet 141 which opens into motor assembly 26. Thus, refrigerant will be conducted through a passage 143 adjacent lower end 144 of rotor 39, through passage 145 adjacent windings 40 and into lower sump 65 through various outlet holes 147 formed in bottom plate 28. The refrigerant then moves along bottom plate 28, through a clearance passage 149 formed between lower housing section 9 and motor housing 26, and out through a housing outlet port 150.

Figure 3:
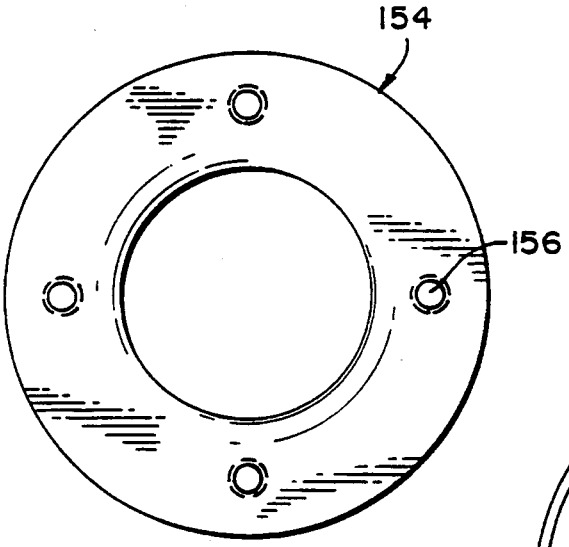
FIG. 3 is a bottom view of the first element shown in FIG. 2.

Reference will now be made to FIGS. 1-7 to describe more specifically the various elements constituting the windage loss reduction arrangement of the present invention. Initially, reference is made to FIGS. 1-3 which show a first windage loss reduction element comprising a lower annular ring 154 surrounding the lower end 57 of drive shaft 58 which is generally rectangular in cross-section but which has a curved corner 155 (See FIG. 2). Lower annular ring 154 is concentrically mounted about upstanding annular bearing flange 34 and includes various circumferentially spaced, internally threaded bores 156. Lower annular ring 154 is fixedly secured to bottom plate 28 of motor housing 26 by means of various screws 158 which extend through bottom plate 28 and are threadable received within bores 156. As shown in FIG. 3, the preferred embodiment utilizes four equally spaced bores 156; however, it should be understood that this arrangement represents the preferred embodiment and that the number of bores is not critical. Actually, any means known in the art could be utilized for securing lower annular ring 154 to motor housing 26. As clearly shown in FIG. 1, the size of lower annular ring 154 directly affects the size of the clearance passage between lower annular ring 154 and rotor 39 and windings 40. Therefore, the size of lower annular ring is actually determined based on the desired optimization of the gap between the ring 154, the rotor 39 and the windings 40. By providing the ring 154, windage flow induced by the lower end of the spinning rotor 39 is controlled to reduce energy losses resulting from the radially outward centrifugal flow of ambient gas or other fluid generated by the spinning rotor 39 which normally would set up an axial flow of fluid towards the bottom of the housing. By providing the ring 154, the gap clearance between the spinning and fixed elements within the housing are controlled to minimize the circulatory flow of the fluids while not increasing drag due to viscous shear.

Figure 4:
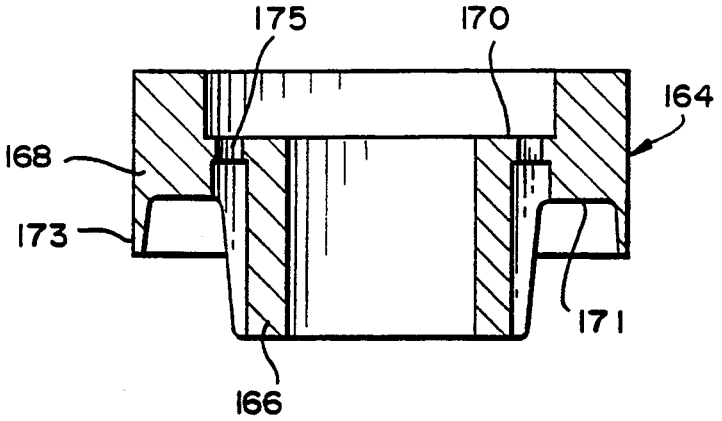
FIG. 4 is an expanded view of a second element of the windage loss reduction arrangement according to the invention.
Figure 5:
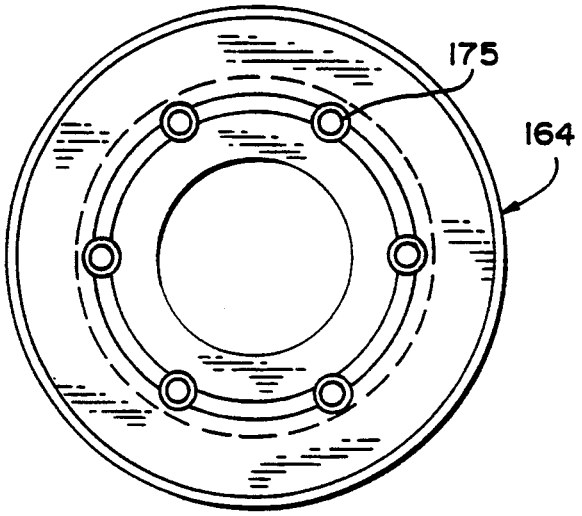
FIG. 5 is a bottom view of the second element shown in FIG. 4.

Spaced longitudinally above lower annular ring 154 is an upper annular ring 164 which constitutes a second element of the windage loss reduction arrangement of the present invention as will be described with reference to FIGS. 1, 4 and 5. Upper annular ring 164 includes a first annular portion 166 which extends substantially parallel to and closely adjacent axially extending drive shaft 58, a second annular portion 168 which is substantially parallel to, but radially spaced from first annular portion 166, and a connecting portion 170. Second annular portion 168 further includes an annular extension portion 173 which projects about an upper end and periphery of rotor 39.

Connecting portion 170 is formed with various, circumferentially spaced apertures 175 which are aligned with various internally threaded bores (not labeled) in crosspiece 31 and which are adapted to receive various screws for securing upper annular ring 164 to crosspiece 31. It should be noted that first annular portion 166 of upper annular ring 164 extends adjacent drive shaft 58 and terminates adjacent a central section 180 of rotor 39. The radially inner side of second annular portion 168 abuts crosspiece 31 and the outer side of second annular portion 168 extends substantially parallel to and closely adjacent an upper portion of windings 40. Furthermore, extension portion 173 extends about an upwardly longitudinally extending, generally trapezoidal section 182 of rotor 39 and between rotor 39 and stator 40. Second annular portion 168 is sized so as to optimize the clearance between drive shaft 58, rotor 39, windings 40 and upper annular ring 164 while permitting cooling and/or lubrication fluid to flow therebetween.

Thus, the second annular portion 168 effectively controls radial and axial windage flow of ambient fluid between the end of the spinning rotor 39 and the adjacent interior of the lower housing section 9. This serves to reduce the windage loss in this area of the scroll fluid apparatus.

Figure 6:
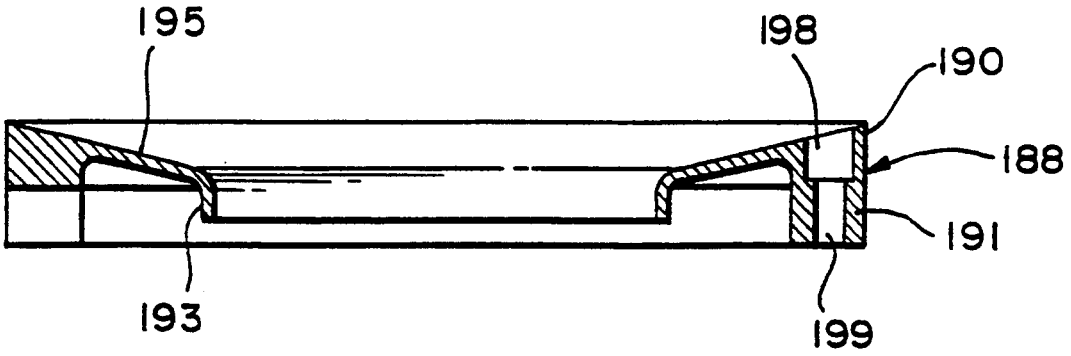
FIG. 6 is an expanded view of a third windage loss reduction element according to the present invention.
Figure 7:
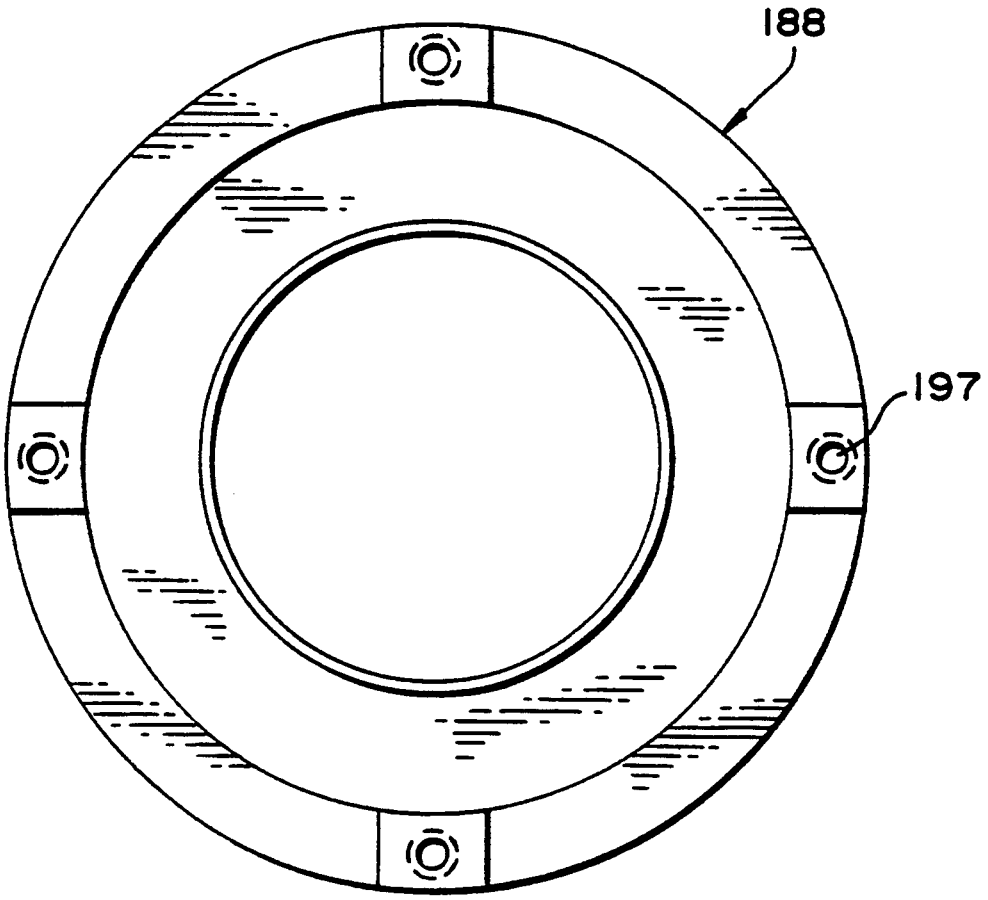
FIG. 7 is a bottom view of the third element shown in FIG. 6.

A third element of the present windage loss reduction arrangement is depicted in FIGS. 1, 6 and 7 and comprises an annular disc 188 located under the drive plate 71, and having an outer circumference 190 which includes a mounting boss 191, an inner radial side 193 and a sloping central portion 195. Mounting boss 191 is formed with various circumferentially spaced through holes 197 (four in the preferred embodiment as depicted in FIG. 7) which include a first diameter portion 198 and a second, reduced diameter portion 199. Crosspiece 31 is formed with various internal bores (not labeled) which are aligned with through holes 197 and which are adapted to receive shanks 202 of screws 203 for securing annular disc 188 thereto. Screws 203 include heads 204 which are recessed within first diameter portion 198 of mounting boss 191.

Annular disc 188 is arranged such that sloping central portion 195 is located closely adjacent to the bottom surface portion of upwardly sloping outer portion 81 of drive plate 71 and so that inner radial side 193 abuts crosspiece 31. As clearly depicted in FIG. 1, annular disc 188 optimizes the clearance space between the rotating drive plate 71 and crosspiece 31 while still permitting a adequate cooling oil fluid flow to the lower surface of drive plate 71. By optimizing the clearance space, radial flow of ambient fluid generated by the spinning drive plate 71 is reduced to minimize windage loss in this area beneath the drive plate 71 while not significantly increasing drag from viscous shear.

Figure 8:
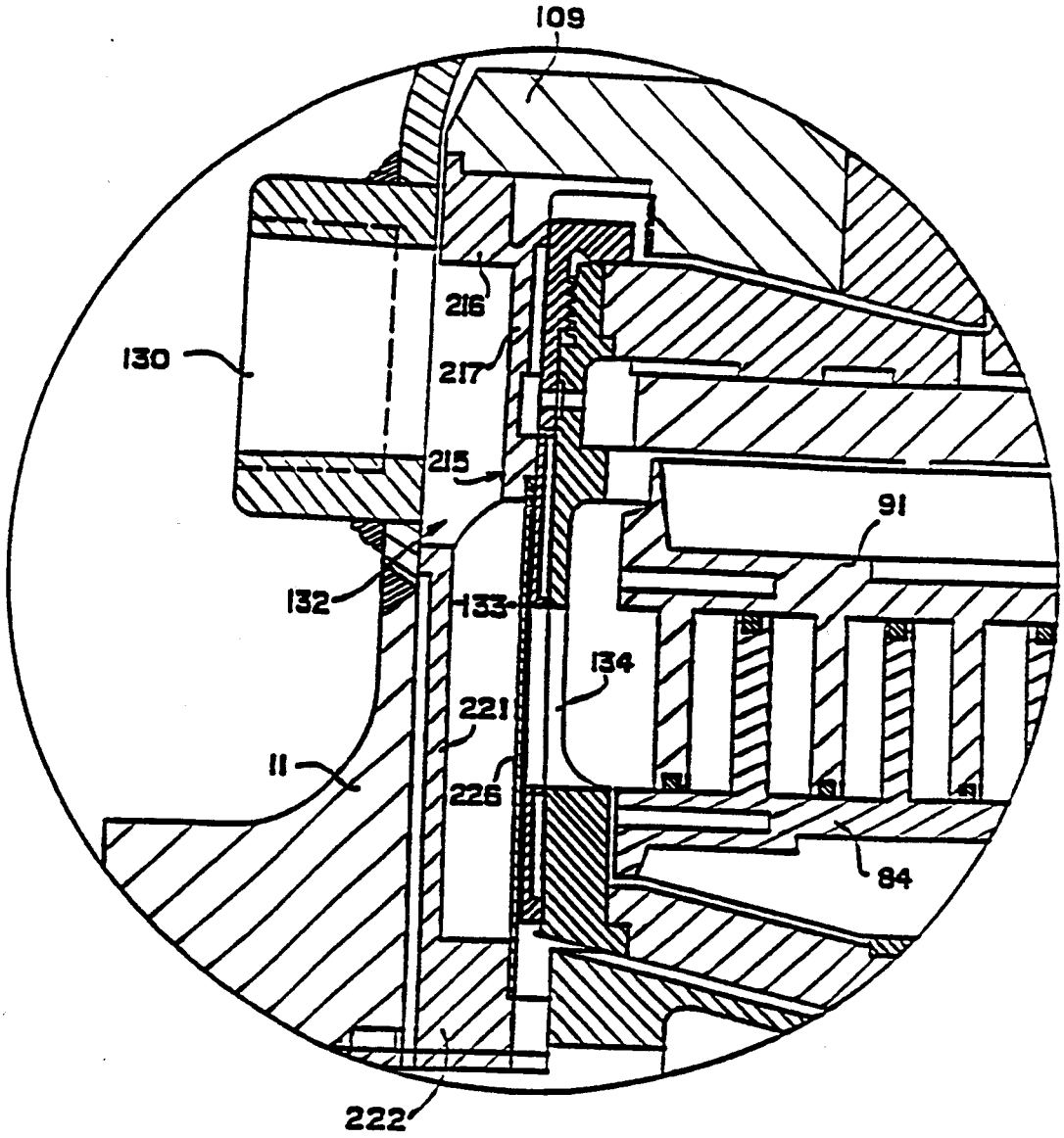
FIG. 8 is an expanded view of the inlet area of the scroll-type compressor shown in FIG. 1 and incorporating a fourth windage loss reduction element.

A fourth element of the windage loss reduction arrangement of the present invention is located within inlet manifold 132 and will be described with particular reference to FIG. 8. Located within inlet manifold 132 is an inlet manifold housing extension 215 which includes an upper attaching member 216, a face plate or ring 217 and a downwardly extending annular leg 221 which terminates in an inwardly extending flange 222. Upper attaching member 216 is fixedly secured to plate 109 within upper housing section 11. Face plate 217 is radially inwardly spaced from housing inlet port 130 and functions to guide pumped fluid downwardly from the inlet port into inlet passage 133.

Extending between face plate 217 and inwardly extending flange 222 is a screen member 226 which is located closely adjacent scroll inlet port 134. Screen member 226 may comprise a perforated portion of inlet manifold housing extension 215 or may comprise a separate annular screen. Screen member 226 is radially spaced from the rotating drive and driven scroll members 84, 91 by a predetermined distance to establish an optimum clearance that reduces windage loss between the rotating set of scrolls and the housing of the scroll inlet port area while avoiding shear drag.

Although described with respect to a particular embodiment of the invention, it is to be understood that the description was for illustrative purposes only and it is not intended that the invention be limited to the particular configuration described. In general, various changes and/or modifications can be made by a person skilled in the art without departing from the spirit of the invention as defined by the following claims.

I claim:

1. A scroll fluid device comprising:

a housing including a fluid inlet port;

a pair of opposed, rotatable scroll elements including axially extending, opposed, meshed, involute scroll wraps, said scroll elements including an axially extending scroll fluid inlet port, associated with and rotatable with said scroll elements, and being mounted in said housing so as to orbit relative to each other about an orbit axis within the housing to generate fluid transport chambers having progressively and cyclically varying volumes between the scroll wraps resulting from the relative orbital motion of the scroll wraps;

at least one rotating member in the housing associated with the scroll elements and having at least one generally radially extending surface, said radially extending surface extending along an adjacent fixed surface within the housing;

means for reducing windage at least between said radially extending surface and said adjacent fixed surface, said means for reducing windage being positioned between said scroll fluid inlet port and said housing.

2. A scroll fluid device as claimed in claim 1 wherein said windage reducing means comprises an axially extending fixed screen element extending parallel to and closely adjacent said scroll fluid inlet port, said screen element being spaced from said scroll fluid inlet port by a predetermined gap clearance dimensioned to produced a reduction of windage between said scroll fluid inlet port and said housing.

3. A scroll fluid device as claimed in claim 1 wherein said scroll elements are arranged to co-rotate about parallel axes to generate said fluid transport chambers.

4. A scroll fluid device as claimed in claim 3 including:

at least one axially extending surface extending along an adjacent axially extending fixed surface of said housing; and said means for reducing windage also extending between said axially extending surface and said adjacent fixed surface.

5. A scroll fluid device comprising:

a housing;

a pair of opposed scroll elements including axially extending, opposed, meshed, involute scroll wraps, said scroll elements being mounted in said housing so as to orbit relative to each other about an orbit axis within the housing to generate fluid transport chambers having progressively and cyclically varying volumes between the scroll wraps resulting from the relative orbital motion of the scroll wraps;

a drive assembly including a rotor rotatably mounted within said housing and a drive shaft drivingly connected to at least one of said scroll elements, said rotor being drivingly connected to said drive shaft and including upper and lower radially and axially extending end surfaces; and means for reducing windage between said rotor and an adjacent fixed surface within said housing, said windage reducing means being carried by said housing and including a first annular member extending between one of said upper and lower radially and axially extending end surfaces of said rotor and said drive shaft and further extending about the axially extending end surface of said one of said upper and lower radially and axially extending end surfaces, said windage reducing means providing a predetermined gap clearance dimensioned to produce a reduction of windage between the rotating rotor and drive shaft and the adjacent fixed surface within said housing as compared to the windage that would be developed therebetween without said windage reducing means.

6. A scroll fluid device as claimed in claim 5, wherein said windage reducing means further includes a second annular member carried by said housing adjacent the other of said upper and lower radially and axially extending end surfaces of said rotor to provide a predetermined clearance therebetween for windage reduction purposes.

7. A scroll fluid device comprising:

a housing a pair of opposed scroll elements including axially extending, opposed, meshed involute scroll wraps carried by respective wrap support plates, said scroll elements being mounted in said housing so as to orbit relative to each other about an orbit axis within the housing to generate fluid transport chambers having progressively and cyclically varying volumes between the scroll wraps resulting from the relative orbital motion of the scroll wraps;

a drive assembly including a drive shaft rotatably mounted in said housing and a drive plate carried by said drive shaft so as to rotate in unison therewith, said drive plate extending radially within said housing substantially parallel to at least one of said wrap support plates so as to define a radially extending drive plate surface and being drivingly connected to at least one of said scroll elements; and means for reducing windage between said drive plate and an adjacent fixed surface within said housing, said windage reducing means including a disc carried by said housing and extending closely adjacent to and along a substantial portion of said radially extending drive plate surface so as to define a predetermined gap clearance dimensioned to produce a reduction of windage between said drive plate and the adjacent fixed surface within said housing as compared to the windage that would be developed therebetween without said windage reducing means.

8. A scroll fluid device as claimed in claim 7, wherein said scroll elements are arranged to co-rotate about parallel axes to generate said fluid transport chambers.

* * * * *